US006474005B2

(12) United States Patent
Kobayashi

(10) Patent No.: US 6,474,005 B2
(45) Date of Patent: Nov. 5, 2002

(54) GOLF SHOES

(75) Inventor: Kazuhiko Kobayashi, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 09/919,825

(22) Filed: Aug. 2, 2001

(65) Prior Publication Data

US 2002/0043006 A1 Apr. 18, 2002

(30) Foreign Application Priority Data

Aug. 3, 2000 (JP) ..... 2000-235228

(51) Int. Cl.[7] ..... A43B 5/00; A43B 15/00; A43C 15/00

(52) U.S. Cl. ..... 36/127; 36/59 C; 36/67 R; 36/67 A; 36/114; D2/906; D2/954

(58) Field of Search ..... D2/906, 908, 946, D2/951, 954, 955, 956; 36/67 D, 67 R, 67 A, 67 B, 67 C, 59 B, 59 C, 132, 127, 134, 114, 116, 141

(56) References Cited

U.S. PATENT DOCUMENTS

| | | | | | |
|---|---|---|---|---|---|
| 2,553,616 | A | * | 5/1951 | Walls | D2/955 |
| 3,593,436 | A | * | 7/1971 | Vietas | 36/59 C |
| D241,585 | S | * | 9/1976 | Famolare, Jr. | D2/906 |
| 5,293,701 | A | * | 3/1994 | Sullivan | 36/67 D |
| D352,155 | S | * | 11/1994 | Merceron | D2/956 |
| D357,347 | S | * | 4/1995 | Leick | D2/951 |
| D407,192 | S | * | 3/1999 | Chassaing | D2/953 |
| D408,976 | S | * | 5/1999 | Shanks et al. | D2/954 |
| D426,053 | S | * | 6/2000 | Santa | D2/954 |
| D446,635 | S | * | 8/2001 | Pollastrelli | D2/954 |

FOREIGN PATENT DOCUMENTS

| | | |
|---|---|---|
| JP | 02-295503 | 12/1990 |
| JP | 11-164703 | 6/1999 |

* cited by examiner

*Primary Examiner*—Anthony D. Stashick
(74) *Attorney, Agent, or Firm*—Birch, Stewart, Kolasch & Birch, LLP

(57) ABSTRACT

Golf shoes comprise a shoe 1 for a pivoting foot and a shoe 3 for a kicking foot. Outsoles of the shoe 1 for a pivoting foot and the shoe 3 for a kicking foot are formed of rubber or synthetic resin. A projection 7 is formed on a bottom surface of the shoe 3 for a pivoting foot. The projection 7 includes an almost semicircular bottom surface 11, a toe side wall 13 to be a curved surface and a heel side wall 15 to be a rectangular plane. The toe side wall 13 has a convex shape in a direction of a toe. A projection 19 is formed on a bottom surface of the shoe 3 for a kicking foot. The projection 19 includes an almost semicircular bottom surface 22, a heel sidewall 23 to be a curved surface and a toe side wall 25 to be a rectangular plane. The heel side wall 23 has a convex shape in a direction of a heel. If a golf player wears the golf shoes, slip can be prevented during a swing.

6 Claims, 6 Drawing Sheets

GOLF SHOES

BACKGROUND OF THE INVENTION

1. Field of the Invention

The present invention relates to golf shoes, and more particularly to an improvement in a pattern of a bottom surface of golf shoes.

2. Description of the Related Art

When hitting a golf ball, a golf player sets an address such that a line connecting right and left tiptoes are in almost parallel with a hitting direction. In an address for a right-handed golf player, a left foot is positioned on the front side in the hitting direction and a right foot is positioned on the rear side in the hitting direction. In the address, a head of a golf club is positioned close to a golf ball. In this state, the golf player starts take-back, pulls the head rearward and then swings the golf club upward. The highest position of the head swung upward is equivalent to a top position. In the top position, a downswing is started and the head is swung downward so that the head impacts the golf ball. After the impact, the golf player swings the golf club forward and then upward (follow-through). Thus, a finish is attained.

From the top position to the finish, the golf player carries out a body turn by setting a left foot as a pivot. At the same time, the golf player kicks the ground by a right foot to transmit the force to the golf ball. In other words, a right-handed golf player uses a left foot as a pivoting foot and a right foot as a kicking foot. To the contrary, a left-handed golf player uses a right foot as a pivoting foot and a left foot as a kicking foot.

From the top position to the finish, great force is applied to both feet of the golf player. In some cases, the force causes golf shoes to slip off from the ground. In some cases in which the slip is caused, a swing form is disordered so that a misshot is generated.

In order to attain slip prevention, a needle-like spike pin formed of metal or ceramics is provided on the bottom surfaces of the golf shoes in some cases. In such golf shoes, the slip is considerably prevented. However, there is a problem in that the spike pin damages a lawn in a putting green, a floor in a clubhouse and a road surface of a passage for walking which is provided in a golf course. Moreover, the golf shoes having the spike pin give a push-up feeling and are not comfortable for the golf player to wear. In recent years, the golf shoes having the spike pin have not been preferred for use.

Golf shoes having a projection formed of rubber or synthetic resin which are provided on bottom surfaces in place of the spike pin have been proposed and spread. Such golf shoes rarely damage a lawn and are very comfortable to wear. In the golf shoes, however, there is a problem in that the projection has less slip prevention performance than the spike pin. Japanese Patent No. 2946215 has proposed golf shoes in which a shoe for a left foot and a shoe for a right foot have different projection patterns in consideration of a difference in a role between the left and right feet. In respect of an enhancement in the slip prevention performance, however, the golf shoes still leave room for an improvement.

The present inventor investigated a vector of force applied to feet from the top position to the impact (that is, a magnitude and a direction) and found the following.

For a pivoting foot, force is roughly applied in a direction from a heel to a toe (which will be hereinafter referred to as "a front direction". In detail, the force is mainly applied to a rear portion in the hitting direction of the foot in the top position (toward an inside for the pivoting foot of the golf player) and the direction is also equivalent to a slightly rearward front direction. Depending on the progress of a swing, the position to which the force is mainly applied is transferred to the center of the foot, and then a front portion (toward an outside for the pivoting foot of the golf player). Depending on the progress of the swing, moreover, the direction of the force is also transferred in a completely front direction, and then in a slightly forward front direction. It is supposed that these changes are caused by a body turn using a pivoting foot as a pivot and movement of a weight.

For a kicking foot, force is roughly applied in a direction from a toe to a heel (which will be herein after referred to as "a back direction". In detail, the force is mainly applied to a front portion in the hitting direction of the foot in the top position (toward an inside for the kicking foot of the golf player) and the direction is also equivalent to a slightly forward back direction. Depending on the progress of a swing, the position to which the force is mainly applied is transferred to the center of the foot, and then a rear portion (toward an outside for the kicking foot of the golf player). Depending on the progress of the swing, moreover, the direction of the force is also transferred in a completely back direction, and then in a slightly rearward back direction. It is supposed that these changes are caused by movement of a weight from the kicking foot to the pivoting foot at the time of the start of a downswing and the subsequent rotation of the kicking foot.

The present invention has been made based on these knowledges and has an object to provide golf shoes which can be prevented from slipping during a golf swing.

SUMMARY OF THE INVENTION

In order to achieve the above-mentioned object, the present invention provides golf shoes comprising a shoe for a pivoting foot which is positioned on a front side in a hitting direction and a shoe for a kicking foot which is positioned on a rear side in the hitting direction when a golf player is to hit a golf ball, the shoe for a pivoting foot and the shoe for a kicking foot including a outsole body, and a large number of projections formed of rubber or synthetic resin are provided on a bottom surface of the outsole body, wherein the projections having a convex side wall in a direction of a toe are mainly formed on the shoe for a pivoting foot and the projections having a convex side wall in a direction of a heel are mainly formed on the shoe for a kicking foot.

In the golf shoes, projections corresponding to a fluctuation in a vector of force applied to each of the pivoting foot and the kicking foot during a swing are formed in the shoe for the pivoting foot and the shoe for the kicking foot, respectively. More specifically, the projection includes a side wall which is almost orthogonal to the vector of the force at each of points from a top position to an impact position. Accordingly, it is possible to prevent the golf shoes from slipping off from the ground (a slip in almost a direction of a toe of the shoe for the pivoting foot and a slip in almost a direction of a heel of the shoe for the kicking foot).

It is preferable that an interior angle formed by the convex side wall in the direction of a toe and the outsole body over a vertical section of the shoe for a pivoting foot should be 60 degrees or more. It is preferable that an interior angle formed by the convex side wall in the direction of a heel and the outsole body over a vertical section of the shoe for a kicking foot should also be 60 degrees or more. By setting the interior angle to 60 degrees or more, the slip prevention performance of the golf shoes can be more enhanced.

It is preferable that a ratio of a total grounding area of the projections to a bottom surface area of the outsole body in each of the shoe for a pivoting foot and the shoe for a kicking foot should be 20% to 80%. Consequently, the slip prevention performance of the golf shoes can be more enhanced.

It is preferable that the number of the projections in each of the shoe for a pivoting foot and the shoe for a kicking foot should be 10 to 1000. Consequently, the slip prevention performance of the golf shoes can be more enhanced.

It is preferable that the projections of the shoe for a pivoting foot should be formed along a convex line in a direction of a toe. It is preferable that projections of the shoe for a kicking foot is formed along a convex line in a direction of a heel. Consequently, the slip prevention performance of the golf shoes can be more enhanced, and the easiness for a golf player to swing can be improved.

DESCRIPTION OF THE PREFERRED EMBODIMENTS

Figure 1:
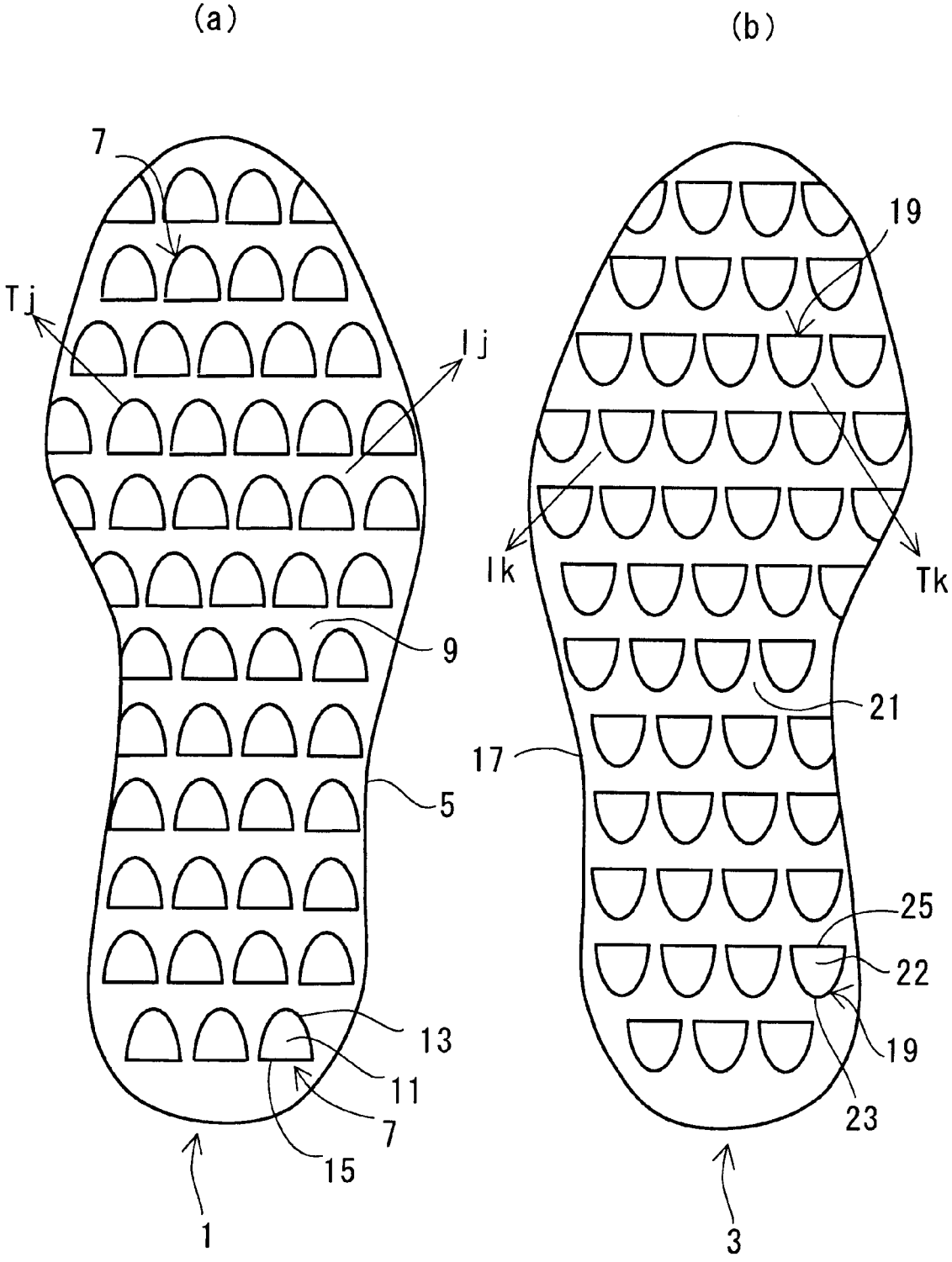
FIG. 1 is a bottom view showing golf shoes according to an embodiment of the present invention.

The present invention will be described below in detail based on a preferred embodiment with reference to the drawings. The drawings to be used in the following description show golf shoes for right-handed golf players. Accordingly, a left foot wears a shoe for a pivoting foot and a right foot wears a shoe for a kicking foot. Golf shoes for left-handed golf players have shapes obtained by transversely inverting the shape shown in the following drawings FIG. 1(*a*) is a bottom view showing a shoe 1 for a pivoting foot of golf shoes according to an embodiment of the present invention, and FIG. 1(*b*) is a bottom view showing a shoe 3 for a kicking foot of the golf shoes. The golf shoes comprise the same upper portion and insole as those of ordinary golf shoes, which is not shown. In FIGS. 1(*a*) and 1(*b*), a right direction is set to the front side in a hitting direction, a left direction is set to the rear side in the hitting direction, an upward direction is set to a direction of a toe, and a downward direction is set to a direction of a heel.

The shoe 1 for a pivoting foot has a outsole body 5. A large number of projections 7 are formed on the bottom surface of the outsole body 5. A portion on the bottom surface other than the projections 7 is a flat portion 9. The shoe outsole body 5 and the projections 7 are formed integrally. The outsole body 5 and the projections 7 are formed of a composition containing rubber or synthetic resin as a principal component.

Figure 2:
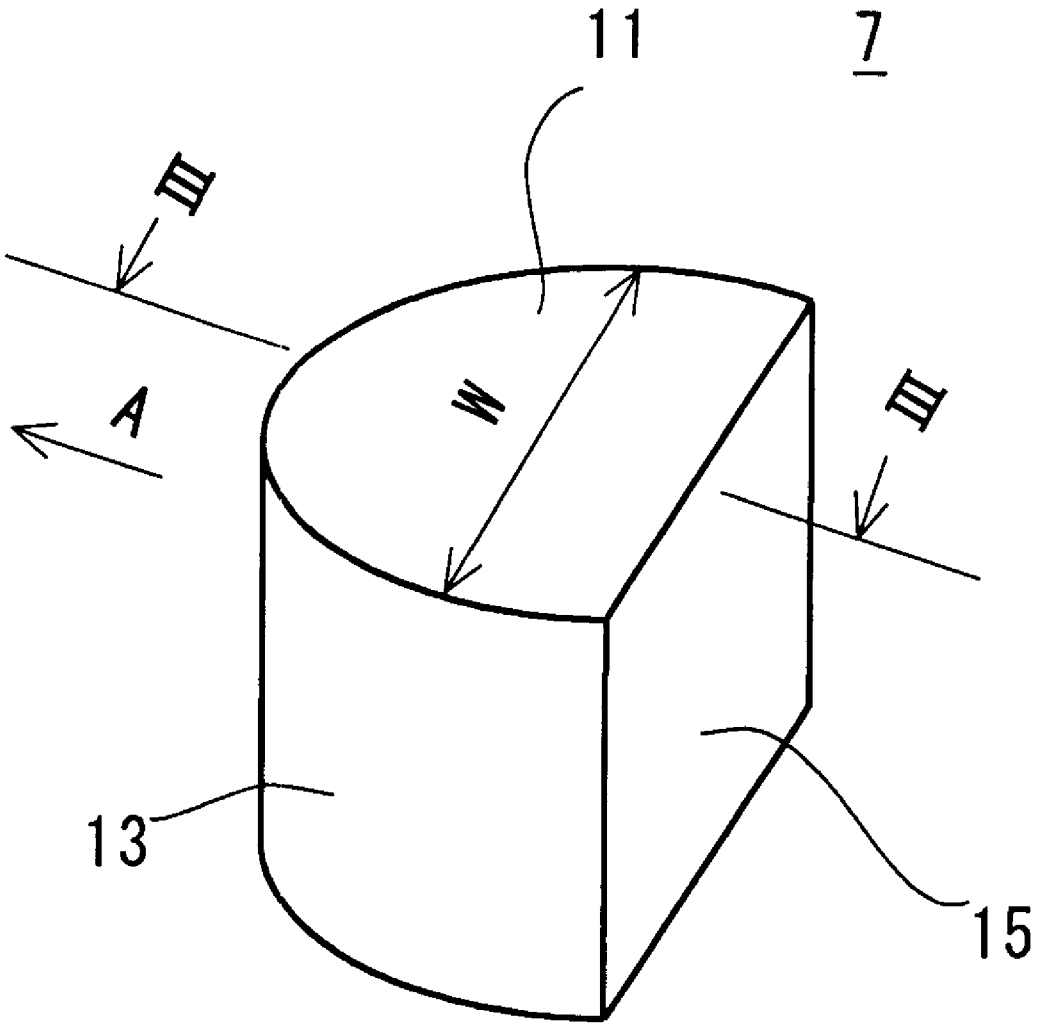
FIG. 2 is an enlarged perspective view showing a projection of a shoe for a pivoting foot of the golf shoes illustrated in FIG. 1.

FIG. 2 is an enlarged perspective view showing the projections 7 of the shoe 1 for a pivoting foot. The projection 7 is a column having an almost semicircular bottom surface 11 (that is, a similar shape to a solid obtained by dividing the circular column into two portions along an axis thereof). As is apparent from a contrast between FIG. 1(*a*) and FIG. 2, a direction of an arrow A shown in FIG. 2 is set to the direction of a toe. A side wall of the projection 7 has a toe side wall 13 to be a curved surface and a heel sidewall 15 to be a rectangular plane. The toe side wall 13 has a convex shape in the direction of a toe. A width in a hitting direction of the toe side wall 13 (shown in an arrow W of FIG. 2) is gradually reduced toward the toe. The projection 7 is convex in the direction of the toe and is not convex in a direction of a heel.

In FIG. 1(*a*), a narrow Tj indicates a vector of force applied to a pivoting foot in a top position. An arrow Ij indicates a vector of force applied to the pivoting foot immediately before an impact. During a swing from the top position to a position immediately before the impact, the position and direction of the force applied to the pivoting foot are momentarily changed in an almost clockwise direction in the drawing from a state shown in the arrow Tj to a state shown in the arrow Ij.

As described above, the toe side wall 13 has a convex shape in the direction of the toe. During the vector of the force is transferred from the state shown in the arrow Tj to the state shown in the arrow Ij, any portion of the toe side wall 13 is almost orthogonal to a direction of the vector. Consequently, the shoe 1 for a pivoting foot can be effectively prevented from slipping.

The projection 7 has a convex shape in the direction of the toe. As compared with the case in which a projection having a circular section is formed, therefore, a grounding area is controlled and a sufficient slip prevention performance can be obtained.

It is sufficient that the toe side wall 13 has a convex shape in the direction of the toe and the shape thereof is not restricted. For example, the outline may be a circular arc or a parabola. Moreover, the outline may be a curve having an inflection point in the middle, for example, a sine curve. Furthermore, a combination of a plurality of segments or a combination of a segment and a curve may be used.

Figure 3:
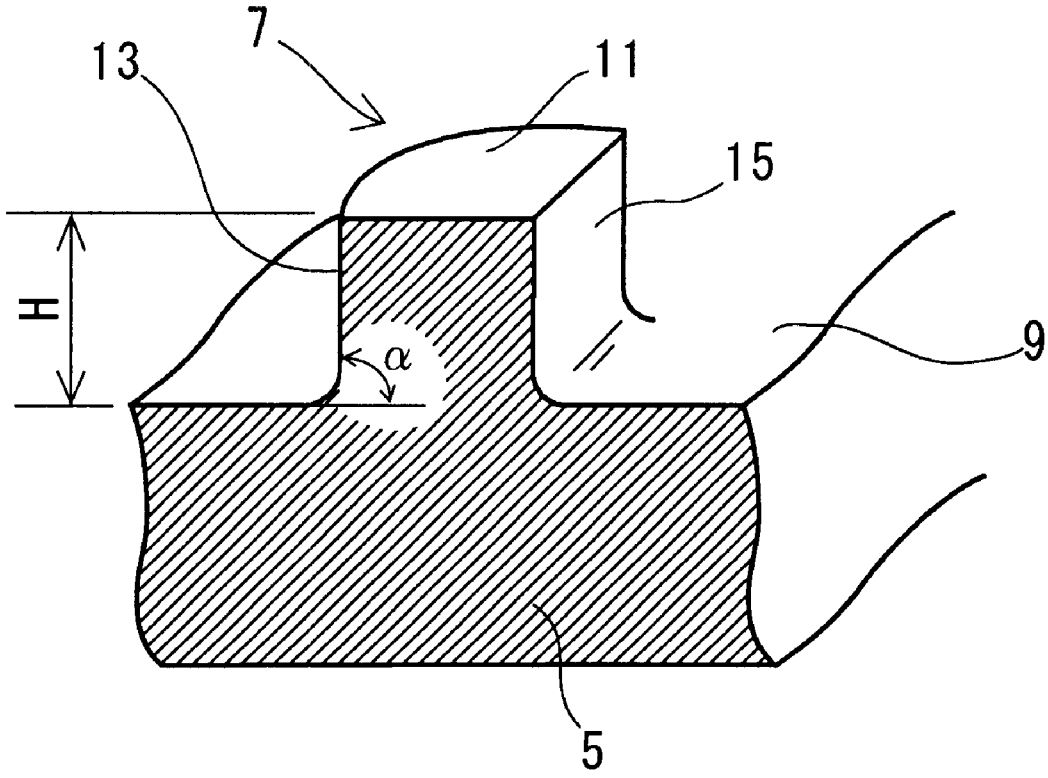
FIG. 3 is a sectional perspective view taken along the line III—III in FIG. 2.

FIG. 3 is a sectional perspective view (a vertical sectional perspective view) taken along the line III—III in FIG. 2. In FIG. 3, the outsole body 5 is shown together with the projection 7. In FIG. 3, $\alpha$ indicates an interior angle formed by the tow sidewall 13 and the outsole body 5. The interior angle $\alpha$ is preferably 60 degrees or more, and more preferably 80 degrees or more. If the interior angle $\alpha$ is less than the above-mentioned range, the slip prevention performance of the shoe 1 for a pivoting foot becomes insufficient in some cases. It is preferable that the interior angle should be 120 degrees or less. If the interior angle $\alpha$ is more than 120 degrees, it is hard to remove the outsole body 5 from a mold for molding. In the shoe 1 for a pivoting foot, the interior angle $\alpha$ is almost 90 degrees.

A height of the projection 7 (shown in an arrow H in FIG. 3) is preferably 2 mm to 25 mm, and more preferably 5 mm to 12 mm. If the height H is less than the above-mentioned range, the slip prevention performance becomes insufficient in some cases. If the height H is more than the above-mentioned range, the projection 7 is bent in some cases.

The shoe 3 for a kicking foot (see FIG. 1(*b*)) also has a outsole body 17. A large number of projections 19 are formed on the bottom surface of the outsole body 17. A portion on the bottom surface other than the projections 19 is a flat portion 21. The outsole body 17 and the projections 19 are formed integrally. The outsole body 17 and the projections 19 are formed of a composition containing rubber or synthetic resin as a principal component.

Figure 4:
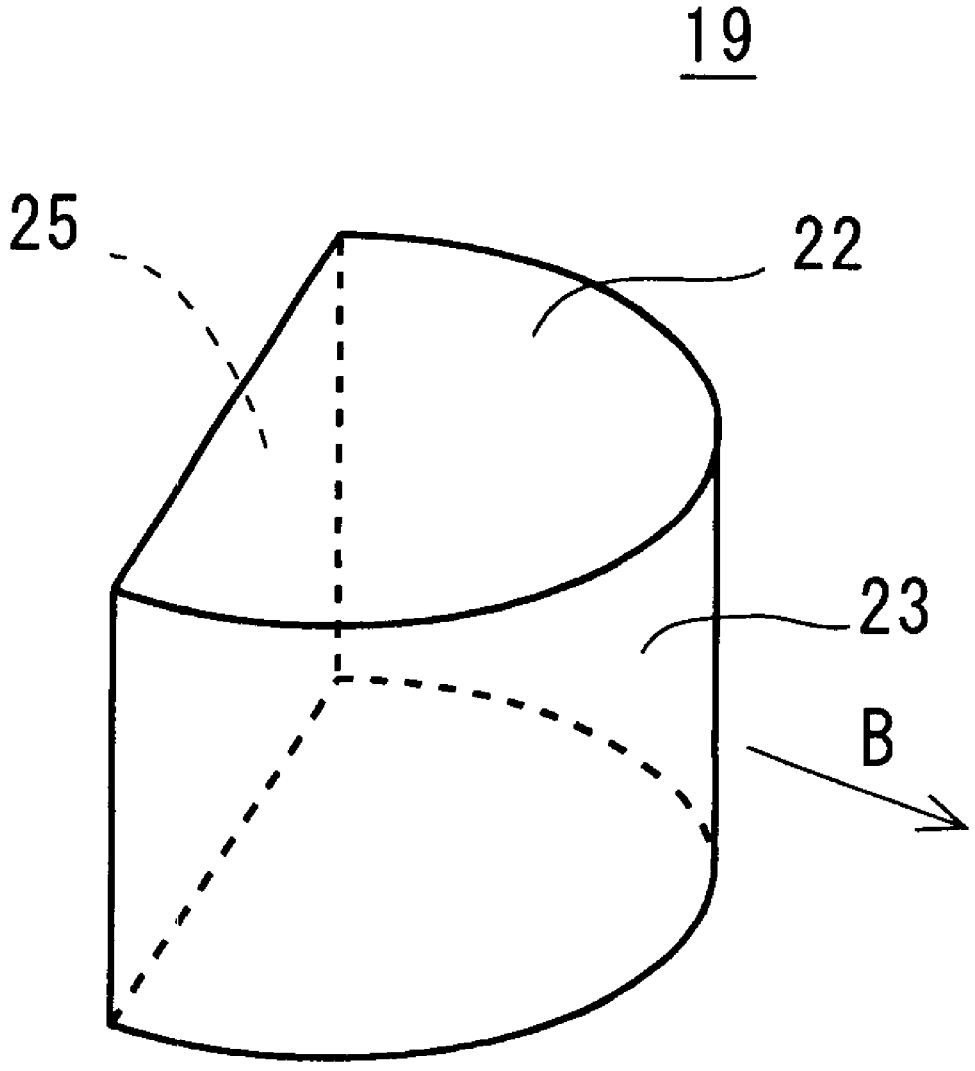
FIG. 4 is an enlarged perspective view showing a projection of a shoe for a kicking foot of the golf shoes illustrated in FIG. 1.

FIG. 4 is an enlarged perspective view showing the projections 19 of the shoe 3 for a kicking foot. The projection 19 has a similar shape to the projection 7 of the shoe 1 for a pivoting foot shown in FIG. 2 and has a bottom surface 22. As is apparent from a contrast between FIG. 1(*b*) and FIG. 4, a direction of an arrow B shown in FIG. 4 is the direction of a heel. A side wall of the projection 19 has a heel side wall 23 to be a curved surface and a toe side wall 25 to be a rectangular plane. The heel side wall 23 has a convex shape in the direction of a heel. In other words, the projection 19 is convex in the direction of the heel and is not convex in the direction of the toe.

In FIG. 1(*b*), an arrow Tk indicates a vector of force applied to a kicking foot in a top position. An arrow Ik indicates a vector of force applied to the kicking foot immediately before an impact. During a swing from the top position to a position immediately before the impact, the position and direction of the force applied to the kicking foot are momentarily changed in an almost clockwise direction in the drawing from a state shown in the arrow Tk to a state shown in the arrow Ik.

As described above, the heel side wall 23 has a convex shape in the direction of the heel. During the vector of the force is transferred from the state shown in the arrow Tk to the state shown in the arrow Tk, any portion of the heel side wall 23 is almost orthogonal to a direction of the vector. Consequently, the shoe 3 for a kicking foot can be effectively prevented from slipping.

It is sufficient that the heel side wall 23 has a convex shape in the direction of the heel and the shape thereof is not restricted. An interior angle formed by the heel side wall 23 and the outsole body 17 is preferably 60 degrees to 120 degrees in the same manner as that in the toe side wall 13 of the shoe 1 for a pivoting foot, and more preferably 80 to 120 degrees. The height H of the projection 19 is preferably 2 mm to 25 mm, and more preferably 5 mm to 12 mm in the same manner as in the projection 7 of the shoe 1 for a pivoting foot.

It is preferable that a ratio of the total grounding area of the projection to the bottom surface area of the outsole body in the shoe 1 for a pivoting foot and the shoe 3 for a kicking foot should be 20% to 80% respectively. If the grounding area ratio is less than the above-mentioned range, the rigidity of the projection becomes insufficient and unstable in some cases. From this viewpoint, it is particularly preferable that the grounding area ratio should be 40% or more. If the grounding area ratio is more than the above-mentioned range, a grounding pressure becomes insufficient in some cases. From this viewpoint, it is particularly preferable that the grounding area ratio should be 70% or less. The bottom area of the outsole body implies the area obtained on the assumption that the bottom surface is flat (that is, the projections 7 and 19 are not formed) The grounding area of the projection implies the area of bottom surface of the projection, and an almost semicircular area is a grounding area in the projections 7 and 19 shown in FIGS. 2 and 4, for example. The total grounding area implies the total of all grounding areas of the projections formed in the shoe 1 for a pivoting foot and the shoe 3 for a kicking foot, respectively.

It is preferable that the number of the projections in the shoe 1 for a pivoting foot and the shoe 3 for a kicking foot should be 10 to 1000, respectively. If the number of the projections is less than the above-mentioned range, a region having a large area in which the projections are not present at all is generated. For example, in the case in which the same region is positioned just below a sesamoid, the slip prevention performance becomes insufficient during walking in some cases. From this viewpoint, it is particularly preferable that the number of the projections should be 40 or more. If the number of the projections is more than the above-mentioned range, the size of the individual projections is reduced so that the rigidity becomes insufficient in some cases. From this viewpoint, it is particularly preferable that the number of the projections should be 200 or less.

While almost all the projections 7 have convex shapes in the direction of the toe in the shoe 1 for a pivoting foot shown in FIG. 1(*a*), the projection 7 having the convex shape in the direction of the toe and the projection having no convex shape in the direction of the toe may be present together. Also in this case, it is preferable that the ratio of the number of the projections 7 having the convex shape in the direction of the toe to the number of all the projections should be 50% or more, and more preferably 75% or more in respect of maintenance of the slip prevention performance.

While almost all the projections 19 have convex shapes in the direction of the heel in the shoe 3 for a kicking foot shown in FIG. 1(*b*), the projection 19 having the convex shape in the direction of the heel and the projection having no convex shape in the direction of the heel may be present together. Also in this case, it is preferable that the ratio of the number of the projections 19 having the convex shape in the direction of the heel to the number of all the projections should be 50% or more, and more preferably 75% or more in respect of maintenance of the slip prevention performance.

It is preferable that the horizontal sectional shapes of the toe side wall 13 and the heel side wall 23 should be designed by the following method, for example. First of all, a golf player is caused to carry out a golf swing and floor reaction force in each of horizontal and vertical directions during the swing is measured by a three-dimensional floor reaction force meter to calculate a ratio of a horizontal load to a vertical load. Next, a peak point at which the ratio has a maximum value is determined. Then, a start point at which the ratio has a 60% of the maximum value in a stage of a rise toward the maximum value and an end point at which the ratio has 60% of the maximum value in a stage of a fall from the maximum value are determined. Subsequently, horizontal component vectors of three-dimensional floor reaction force data at an interval are arranged with origins thereof coincident with each other between the start point and the end point. Next, a reference line to connect the front ends of the vectors is assumed. The reference line is subjected to variable power at a predetermined ratio and the side wall is designed to have horizontal sectional shapes which are almost equivalent to a line thus obtained. Such a measuring method has been disclosed in Japanese Laid-Open Patent Publication No. 2000-219431.

Figure 5:
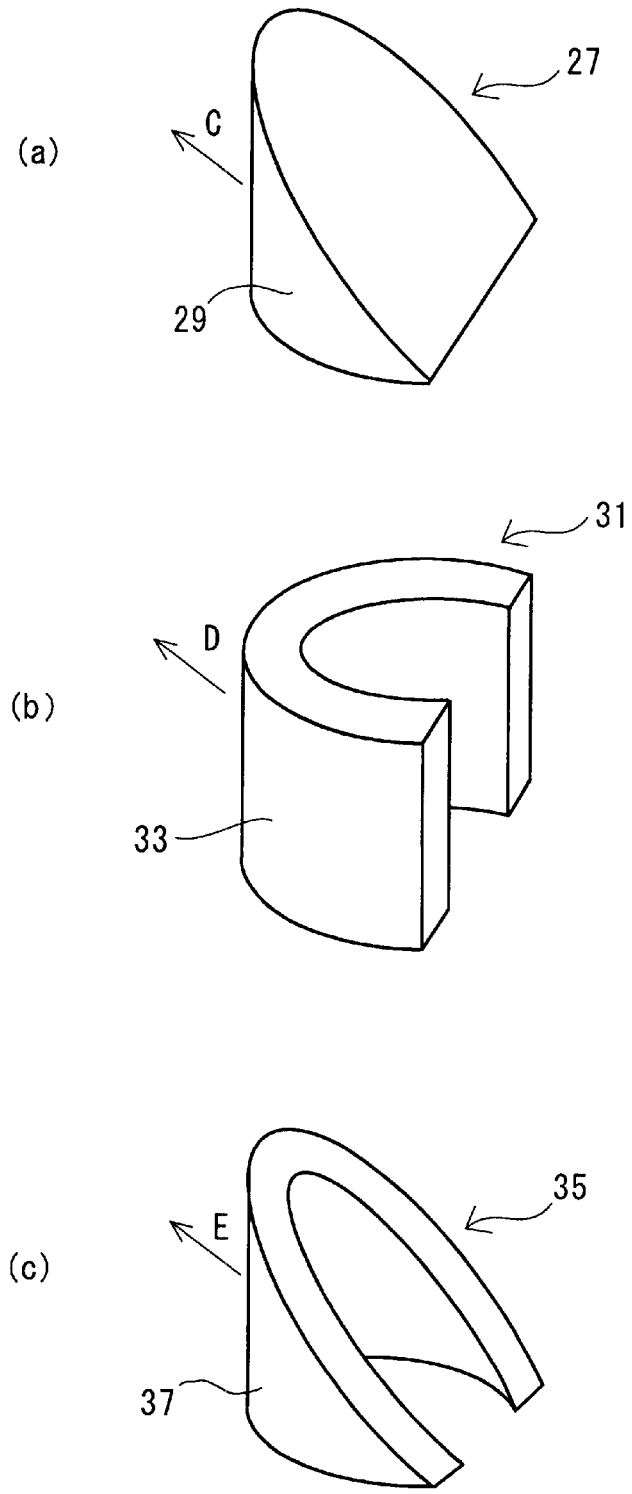
FIG. 5 is a perspective view showing an example of another projection which can be employed for the golf shoes.

The shapes of the projections 7 and 19 are not restricted to those shown in FIGS. 2 and 4. FIGS. 5(*a*) to 5(*c*) are perspective views showing an example of other projections which can be employed for the shoe 1 for a pivoting foot and the shoe 3 for a kicking foot.

A projection 27 shown in FIG. 5(*a*) has such a shape that the projection 7 shown in FIG. 2 is obliquely cut. The projection 27 includes a side wall 29 which is convex in a direction shown in an arrow C. In the case in which the projection 27 is employed for the shoe 1 for a pivoting foot, a direction shown in the arrow C is set to a direction of a toe. In the case in which the projection 27 is employed for the shoe 3 for a kicking foot, the direction shown in the arrow C is set to a direction of a heel.

A projection 31 shown in FIG. 5(*b*) has such a shape that a cylinder is cut along an axis thereof. The projection 31 includes a side wall 33 which is convex in a direction shown in an arrow D. In the case in which the projection 31 is employed for the shoe 1 for a pivoting foot, the direction shown in the arrow D is set to the direction of the toe. In the case in which the projection 31 is employed for the shoe 3 for a kicking foot, the direction shown in the arrow D is set to the direction of the heel.

A projection 35 shown in FIG. 5(*c*) has such a shape that the projection 31 shown in FIG. 5(*b*) is obliquely cut. The projection 35 includes a sidewall 37 which is convex in a direction shown in an arrow E. In the case in which the projection 35 is employed for the shoe 1 for a pivoting foot, a direction shown in the arrow E is set to the direction of the toe. In the case in which the projection 35 is employed for the shoe 3 for a kicking foot, the direction shown in the arrow E is set to the direction of the heel.

Figure 6:
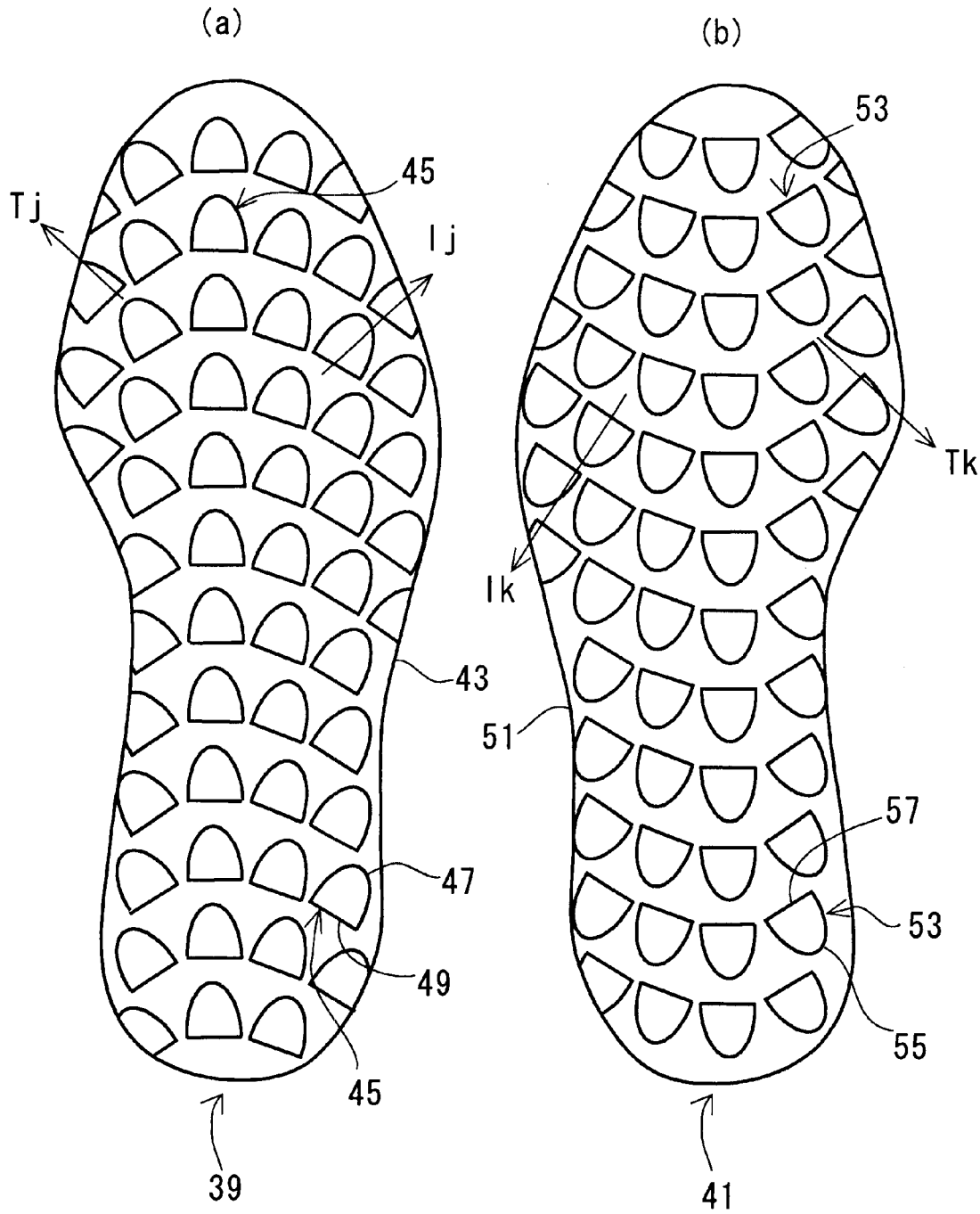
FIG. 6 is a bottom view showing golf shoes according to another embodiment of the present invention.

FIG. 6(*a*) is a bottom view showing a shoe 39 for a pivoting foot of golf shoes according to another embodiment of the present invention, and FIG. 6(*b*) is a bottom view showing a shoe 41 for a kicking foot of the golf shoes.

The shoe 39 for a pivoting foot includes a large number of projections 45 on a outsole body 43. The shape of a projection 45 is almost the same as that of the projection 7 of the shoe 1 for a pivoting foot shown in FIG. 1(*a*), and includes a toe side wall 47 having an almost convex shape in the direction of the toe and a heel side wall 49 to be a plane. In other words, the projection 45 has an almost convex shape in the direction of the toe. Accordingly, during a vector of force is transferred from a state shown in an arrow Tj to a state shown in an arrow Ij over a top position to a position immediately before an impact, any of portions of the toe side wall 47 is almost orthogonal to a direction of the vector. Consequently, the shoe 39 for a pivoting foot can be prevented from slipping.

These projections 45 are formed along a convex line in the direction of the toe. During the vector of force is transferred from the state shown in the arrow Tj to the state shown in the arrow Ij, therefore, there is the projection 45 including the toe side wall 47 causing the vector to pass through the vicinity of a center thereof. Consequently, the shoe 39 for a pivoting foot can further be prevented from slipping. With the progress of a swing, the pivoting foot is rotated by setting the vicinity of the heel to be an axis. Since the projection 45 is formed along a line having a convex shape in the direction of the toe, the rotation is smoothened so that a golf player can easily carry out a swing.

The shoe 41 for a kicking foot includes a large number of projections 53 on a outsole body 51. The shape of the projection 53 is almost the same as that of the projection 19 of the shoe 3 for a kicking foot shown in FIG. 1(*b*), and includes a heel side wall 55 having an almost convex shape in the direction of the heel and a toe side wall 57 to be a plane. In other words, the projection 53 has an almost convex shape in the direction of the heel. Accordingly, during a vector of force is transferred from a state shown in an arrow Tk to a state shown in an arrow Ik over a top position to a position immediately before an impact, any of portions of the heel side wall 55 is almost orthogonal to a direction of the vector. Consequently, the shoe 41 for a kicking foot can be prevented from slipping.

These projections 53 are formed along a convex line in the direction of the heel. During the vector of force is transferred from the state shown in the arrow Tk to the state shown in the arrow Ik, therefore, there is the projection 53 including the heel side wall 55 causing the vector to pass through the vicinity of a center thereof. Consequently, the shoe 41 for a kicking foot can further be prevented from slipping. With the progress of a swing, the kicking foot is rotated by setting the vicinity of the toe to be an axis. Since the projection 53 is formed along a line having a convex shape in the direction of the heel, the rotation is smoothened so that a golf player can easily carry out a swing.

It is preferable that the convex line in the direction of the toe along which the projections 45 are provided and the convex line in the direction of the heel along which the projections 53 are provided should have an analogous shape to a reference lines obtained from the horizontal component vectors of the three-dimensional floor reaction force data respectively.

EXAMPLES

Example 1

Rubber composition containing butadiene rubber as a principal component was put in a mold and was heated and crosslinked to form a shoe outsole having a outsole body and a projections. An upper portion and an insole were attached to the shoe outsole to obtain golf shoes according to an example 1. The shape and arrangement of the projections of a shoe for a pivoting foot of the golf shoes are shown in FIG. 1(*a*). Moreover, the shape and arrangement of the projections of a shoe for a kicking foot are shown in FIG. 1(*b*). Each of the shoe for a pivoting foot and the shoe for a kicking foot has a grounding area ratio of approximately 50%.

Example 2

Golf shoes according to an example 2 were obtained in the same manner as those in the example 1 except that a mold is changed and the pattern of a shoe outsole is varied. The shape and arrangement of the projections of a shoe for a pivoting foot of the golf shoes are shown in FIG. 6(*a*). The shape and arrangement of the projections of a shoe for a kicking foot are shown in FIG. 6(*b*). Each of the shoe for a pivoting foot and the shoe for a kicking foot has a grounding area ratio of approximately 50%.

Comparative Example 1

Golf shoes according to a comparative example 1 were obtained in the same manner as those in the example 1 except that a mold is changed and the pattern of a shoe outsole is varied. A shoe for a pivoting foot and a shoe for a kicking foot in the golf shoes have a large number of linear stripe grooves extended in a transverse direction (hitting direction) over a bottom surface. Each of the shoe for a pivoting foot and the shoe for a kicking foot has a grounding area ratio of approximately 50%. The patterns of the shoe for a pivoting foot and the shoe for a kicking foot have shapes inverted transversely.

Comparative Example 2

Golf shoes according to a comparative example 2 were obtained in the same manner as those in the example 1 except that a mold is changed and the pattern of a shoe outsole is varied. A shoe for a pivoting foot and a shoe for a kicking foot in the golf shoes have a large number of projections over a bottom surface. The projection is circular column and has a circular horizontal section. Each of the shoe for a pivoting foot and the shoe for a kicking foot has a grounding area ratio of approximately 50%. The patterns of the shoe for a pivoting foot and the shoe for a kicking foot have shapes inverted transversely.

Evaluation of Golf Shoes

Each of ten right-handed golf players wore golf shoes and hit a golf ball with a driver on a teeing ground of a golf course. A slip prevention performance and easiness to swing were functionally evaluated in five stages of "1" to "5". For the slip prevention performance, the most difficulty to slip was set to "5" and the most easiness to slip was set to "1". For the easiness to swing, the most easiness to swing was set to "5" and the most difficulty to swing was set to "1". A mean value of the evaluation points for the ten golf players is shown in the following Table 1.

TABLE 1

| | Example 1 | Example 2 | Comparative example 1 | Comparative example 2 |
|---|---|---|---|---|
| Pattern of bottom surface | FIG. 1 | FIG. 6 | Stripe groove | Cylindrical projection |
| Slip prevention performance | 5 | 5 | 3 | 3 |
| Easiness to swing | 3 | 5 | 3 | 2 |

In the Table 1, the golf shoes according to the examples 1 and 2 have more excellent evaluation points than those of the golf shoes according to the comparative examples 1 and 2. Consequently, the advantage of the present invention is apparent.

The above description is only illustrative and various changes can be made without departing from the scope of the present invention.

What is claimed is:

1. Golf shoes comprising a pair of shoes used by a golfer having a pivoting foot and a kicking foot having a different arrangement of projections on the sole of each shoe, wherein the projections on each shoe are convex on one side and not convex on the other side, with the convexity being towards the toe on the shoe worn by the pivoting foot, and towards the heel on the other shoe worn by the kicking foot.

2. The golf shoes according to claim 1, wherein an interior angle formed by the convex side of a projection in the direction of a toe over a vertical section of the shoe for the pivoting foot is 60 degrees or more.

3. The golf shoes according to claim 1, wherein an interior angle formed by the convex side of a projection in the direction of a heel over a vertical section of the shoe for the kicking foot is 60 degrees or more.

4. The golf shoes according to claim 1, wherein the ratio of total grounding area of the projections to the bottom surface area in each shoe is 20% to 80%.

5. The golf shoes according to claim 1, wherein the number of the projections in each shoe is 10 to 1000.

6. The golf shoes according to claim 1, wherein the projections of the shoe for the pivoting foot are formed along a convex line in a direction of a toe and the projections of the shoe for the kicking foot are formed along a convex line in a direction of a heel.

* * * * *